US007451499B1

(12) United States Patent
Trotter

(10) Patent No.: US 7,451,499 B1
(45) Date of Patent: Nov. 18, 2008

(54) POOL BARRIER APPARATUS

(76) Inventor: Edward N. Trotter, 6434 Virginia Ave., Saint Louis, MO (US) 63111

( * ) Notice: Subject to any disclaimer, the term of this patent is extended or adjusted under 35 U.S.C. 154(b) by 516 days.

(21) Appl. No.: 11/351,482

(22) Filed: Feb. 13, 2006

(51) Int. Cl.
*E04H 4/00* (2006.01)

(52) U.S. Cl. ..... 4/505; 4/487; 405/63

(58) Field of Classification Search ..... 4/487, 4/505, 514; 405/63
See application file for complete search history.

(56) References Cited

U.S. PATENT DOCUMENTS 3,582,999 A 6/1971 Baker
3,640,073 A * 2/1972 Samsel ..... 405/70
3,813,703 A 6/1974 Beaudin, Jr.
4,065,923 A * 1/1978 Preus ..... 405/70
4,100,746 A * 7/1978 Preus ..... 405/70
4,688,024 A * 8/1987 Gadde ..... 340/550
4,707,869 A 11/1987 Ray
5,054,960 A * 10/1991 Manzano et al. ..... 405/72
5,267,358 A 12/1993 Roy et al.
D351,010 S 9/1994 Buttler
5,385,427 A * 1/1995 Kateley et al. ..... 405/68
5,832,547 A 11/1998 Burroughs
5,953,767 A 9/1999 Cloffey

* cited by examiner

*Primary Examiner*—Charles E Phillips

(57) ABSTRACT

A pool barrier apparatus for providing a barrier between a deep end and a shallow end of a pool includes a netting having an upper edge, a lower edge and a pair of lateral edges. The netting has a length between said lateral edges being substantially equal to a length between side edges of the pool. A plurality of clamps being coupled to the netting adjacent to the upper edge. The clamps are configured to releasably engage a buoy line and suspend the netting from the buoy line.

6 Claims, 5 Drawing Sheets

POOL BARRIER APPARATUS

BACKGROUND OF THE INVENTION

1. Field of the Invention

The present invention relates to pool dividers and more particularly pertains to a new pool divider for providing a barrier between a deep end of a pool and a shallow end of the pool.

2. Description of the Prior Art

The use of pool dividers is known in the prior art. U.S. Pat. No. 3,582,999 describes a system for selectively separating apportion of a pool from another portion of the pool through the use of a rigid barrier. Another type of pool divider is U.S. Pat. No. 4,707,869 having a division line for a pool that is coupled to a buoy line to allow a swimmer to allow swimmer to swim unimpeded by the buoy line such as when swimming laps. Another type of pool divider is U.S. Pat. No. 3,813,703 having a platform that is positioned in a pool to create and area of shallow water.

While these devices fulfill their respective, particular objectives and requirements, the need remains for a device that has certain improved features that allow a user to climb to the surface of the water along the netting and allows the water to flow between the shallow end and the deep end.

SUMMARY OF THE INVENTION

The present invention meets the needs presented above by generally comprising a netting having an upper edge, a lower edge and a pair of lateral edges. The netting has a length between said lateral edges being substantially equal to a length between side edges of the pool. A plurality of clamps being coupled to the netting adjacent to the upper edge. The clamps are configured to releasably engage a buoy line and suspend the netting from the buoy line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
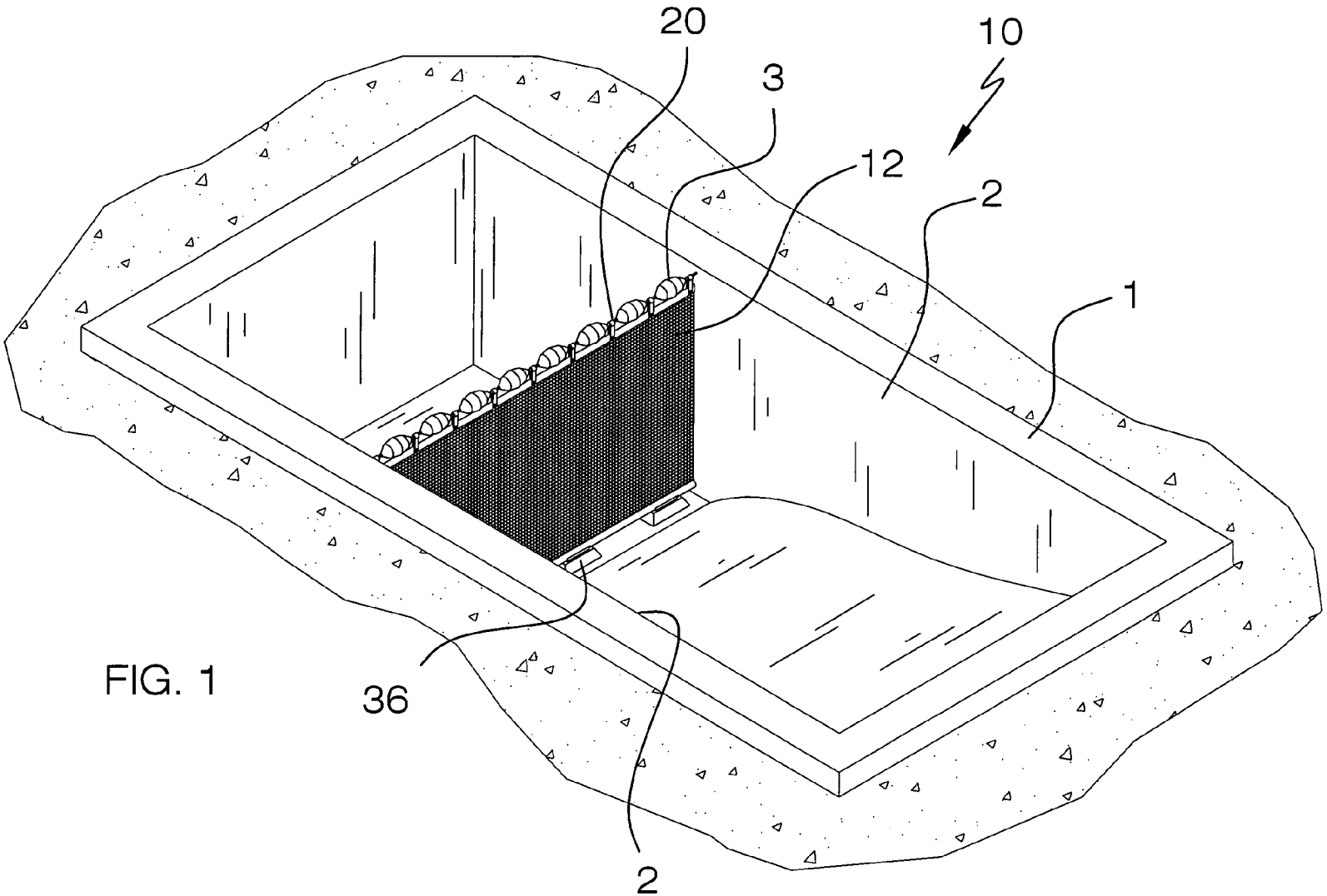
FIG. 1 is a perspective view of a pool barrier apparatus according to the present invention shown in place in a pool.
Figure 2:
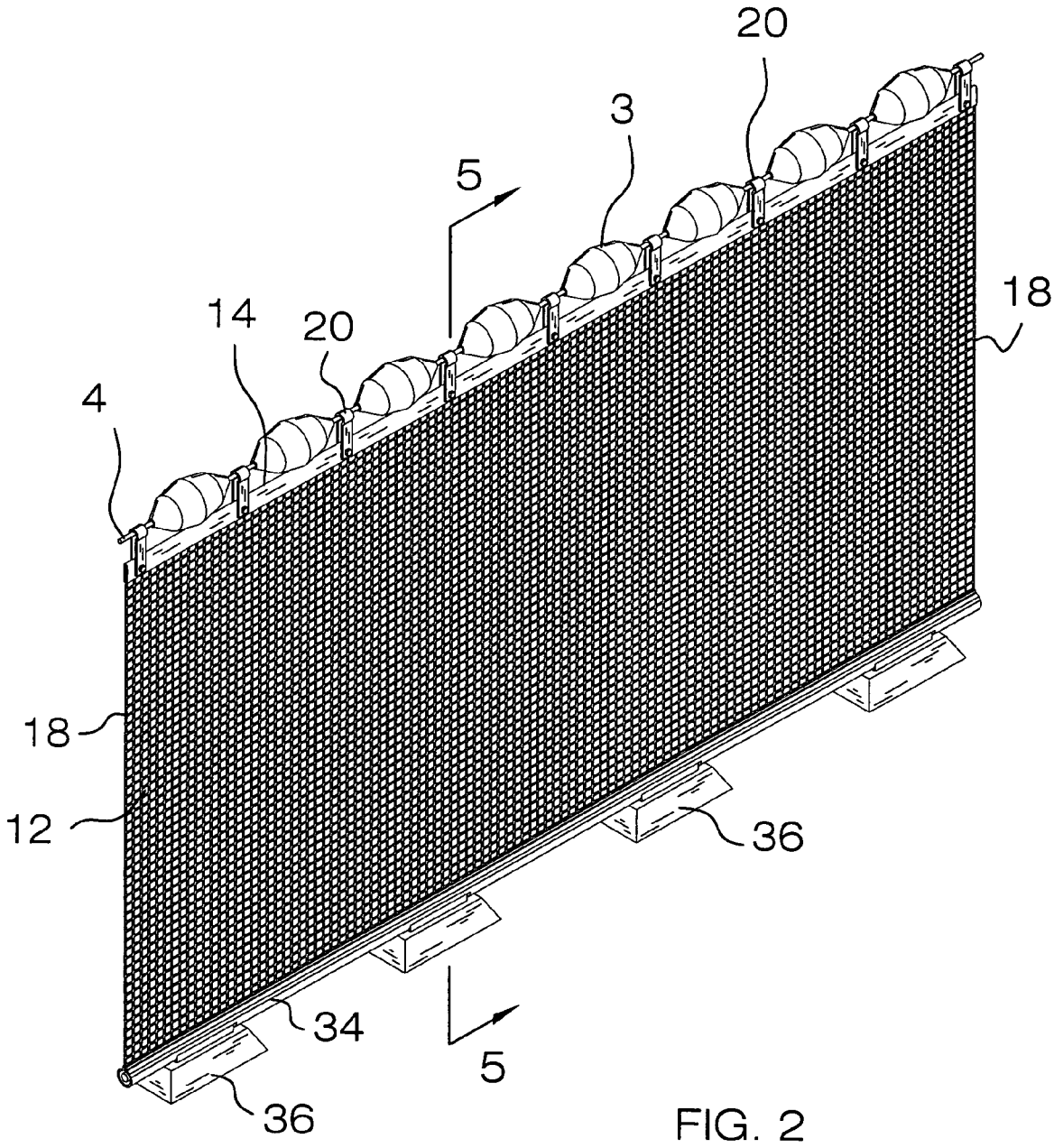
FIG. 2 is a perspective view of the present invention.
Figure 3:
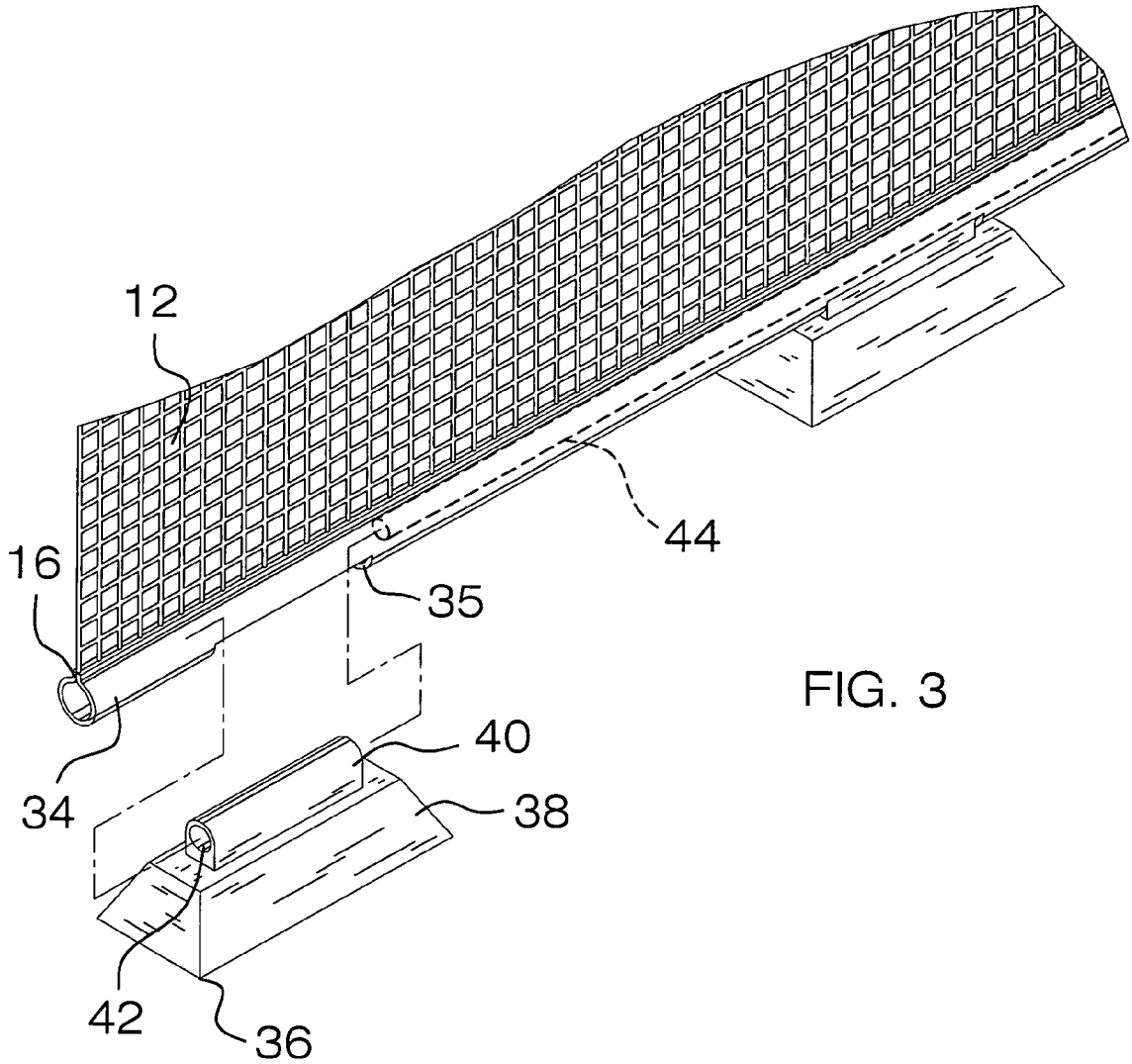
FIG. 3 is an enlarged exploded perspective view of the alignment bar and weights of the present invention.
Figure 4:
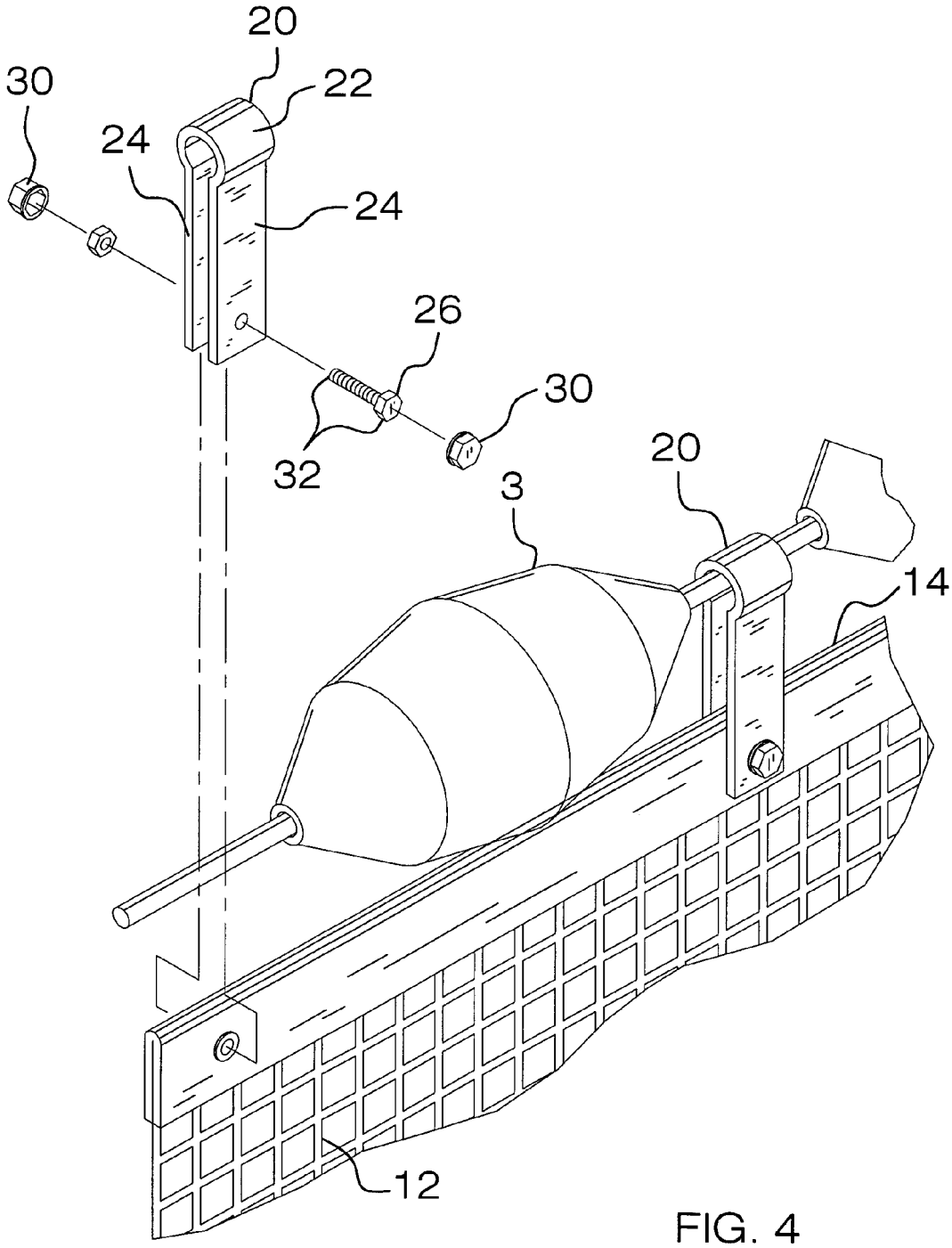
FIG. 4 is an enlarged exploded perspective view of one of the clamps of the present invention.
Figure 5:
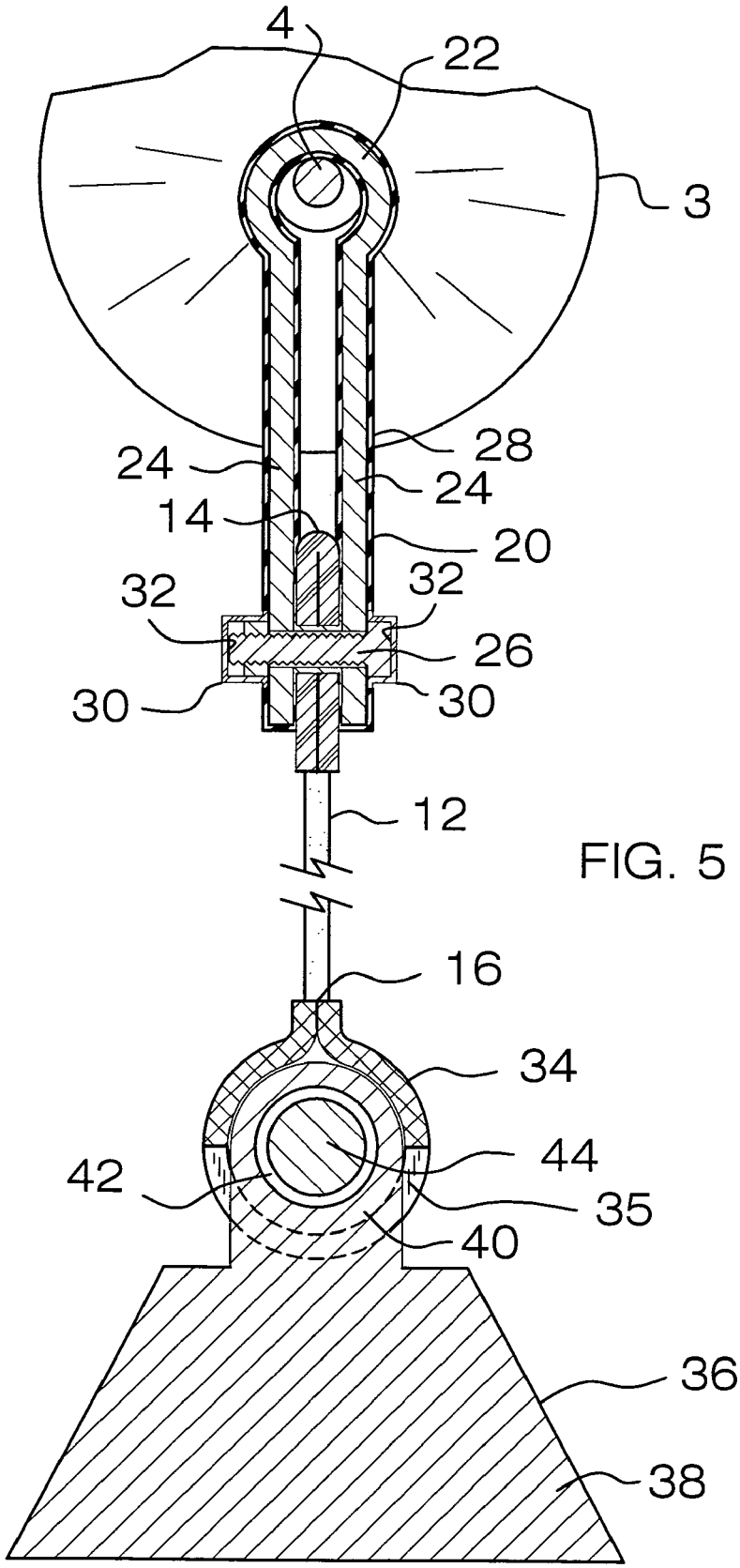
FIG. 5 is a cross-sectional view of the present invention taken along line 5-5 of FIG. 2.

With reference now to the drawings, and in particular to FIGS. 1 through 5 thereof, a new pool divider embodying the principles and concepts of the present invention and generally designated by the reference numeral 10 will be described.

As best illustrated in FIGS. 1 through 5, the pool 1 barrier apparatus 10 generally comprises a netting 12 having an upper edge 14, a lower edge 16 and a pair of lateral edges 18. The netting 12 has a length between the lateral edges 18 being substantially equal to a length between side edges 2 of a pool 1. The netting 12 has a configuration allowing it to be climbed by a user to reach the surface of the water when the user has inadvertently moved from the shallow end to the deep end of the pool 1. This is done by providing a netting 12 having a plurality of openings extending therethrough that each have an area at least equal to one square inch.

A plurality of clamps 20 is coupled to the netting 12 adjacent to the upper edge 14. The clamps 20 are configured to releasably engage a buoy line 3 and suspend the netting 12 from the buoy line 3. Each of the clamps 20 includes an arcuate portion 22 and a pair of arms 24 extending downwardly from the arcuate portion 22. The arms 24 are positioned in a spaced relationship to permit a rope 4 of the buoy line 3 to be slid between the arms 24 of one of the clamps 20 and be received in the arcuate portion 22 of the associated one of the clamps 20. The arms 24 are coupled to the netting 12. Each of the clamps 20 includes a fastener 26 extending through the arms 24 of the associated one of the clamps 20 and the netting 12 positioned between the arms 24 to secure the clamps 20 to the netting 12. Each of the clamps 20 includes a protective coating 28 coupled to an exterior surface of the arms 24 and the arcuate portion 22 to inhibit a user being scratched by the clamps 20 when the user contacts the clamps 20. A plurality of caps 30 engage opposing ends 32 of the fasteners 26. Each of the caps 30 removably receives one of the opposing ends 32 of the fasteners 26 to cover the associated one of the opposing ends 32 and inhibiting the opposing ends 32 of the fasteners 26 from scratching the user.

An alignment tube 34 is coupled to the lower edge 16 of the netting 12. The alignment tube 34 extends along a length of the netting 12 to maintain a substantially planar orientation of the netting 12 with respect to the upper edge 14. A plurality of weights 36 are couplable to the alignment tube 34 to be suspended from the lower edge 16 of the netting 12 and weighting the netting 12 to inhibit the netting 12 shifting out of a desired position. Each of the weights 36 includes a base portion 38 and a mounting portion 40 extending upwardly from the base portion 38. The mounting portion 40 has a bore 42 extending therethrough. The mounting portion 40 of each of the weights 36 is insertable into the alignment tube 34 through one of a plurality of apertures 35 in the alignment tube 34.

A support bar 44 is insertable into the alignment tube 34 and the bore 42 of the mounting portion 40 of each of the weights 36 to secure the weights 36 to the alignment tube 34. The base portion 38 of each of the weights 36 is positioned between the alignment tube 34 and the bottom of the pool 1 when the support bar 44 extends through the alignment tube 34 and the bores 42 of the weights 36.

In use, the buoy line 3 is extended across the pool 1 and the rope 4 of the buoy line 3 is inserted into each of the clamps 20. The netting 12 is coupled to the clamps 20 so that the netting 12 extends downwardly from the buoy line 3 and into pool 1 and along the length of buoy line 3. The alignment tube 34 coupled to the lower edge 16 of the netting 12 keeps the netting 12 in a substantial planar orientation. The weights 36 are coupled to the alignment tube 34 to weight the net and keep the net in a desired position in the pool 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool barrier apparatus for isolating a shallow end from a deep end of a pool, the apparatus comprising:

a netting having an upper edge, a lower edge and a pair of lateral edges, said netting having a length between said lateral edges being substantially equal to a length between side edges of the pool; and a plurality of clamps being coupled to said netting adjacent to said upper edge, said clamps being configured to releasably engage a buoy line and suspending the netting from the buoy line, further comprising an alignment tube being coupled to said lower edge of said netting, said alignment tube extending along a length of said netting to maintain a substantially planar orientation of said netting with respect to said upper edge, weights being couplable to said alignment tube to be suspended from said lower edge of said netting, wherein each of said weights includes a base portion and a mounting portion extending upwardly from said base portion, said mounting portion having a bore extending therethrough, said mounting portion of each of said weights being insertable into said alignment tube through one of a plurality of apertures in said alignment tube, a support bar being insertable into said alignment tube and said bore of said mounting portion of each of said weights to secure said weights to said alignment tube, said base portion of each of said weights being positioned between said alignment tube and the bottom of the pool when said support bar extends through said alignment tube and said bores of said weights.

2. The apparatus according to claim 1, wherein each of said clamps includes an arcuate portion and a pair of arms extending downwardly from said arcuate portion, said arms being positioned in a spaced relationship to permit a rope of the buoy line to be slid between said arms of one of said clamps and be received in said arcuate portion of the associated one of said clamps, said arms being coupled to said netting.

3. The apparatus according to claim 2, wherein each of said clamps includes a fastener extending through said arms of the associated one of said clamps and said netting positioned between said arms to secure said clamps to said netting.

4. The apparatus according to claim 3, further comprising a plurality of caps engaging opposing ends of said fasteners, each of said caps removably receiving one of the opposing ends of the fasteners to cover the associated one of the opposing ends.

5. The apparatus according to claim 2, wherein each of said clamps includes a protective coating being coupled to an exterior surface of said arms and said arcuate portion.

6. A pool barrier apparatus for isolating a shallow end from a deep end of a pool, the apparatus comprising:

a netting having an upper edge, a lower edge and a pair of lateral edges, said netting having a length between said lateral edges being substantially equal to a length between side edges of the pool;

a plurality of clamps being coupled to said netting adjacent to said upper edge, said clamps being configured to releasably engage a buoy line and suspending the netting from the buoy line, each of said clamps including an arcuate portion and a pair of arms extending downwardly from said arcuate portion, said arms being positioned in a spaced relationship to permit a rope of the buoy line to be slid between said arms of one of said clamps and be received in said arcuate portion of the associated one of said clamps, said arms being coupled to said netting, each of said clamps including a fastener extending through said arms of the associated one of said clamps and said netting positioned between said arms to secure said clamps to said netting, each of said clamps including a protective coating being coupled to an exterior surface of said arms and said arcuate portion;

a plurality of caps engaging opposing ends of said fasteners, each of said caps removably receiving one of the opposing ends of the fasteners to cover the associated one of the opposing ends;

an alignment tube being coupled to said lower edge of said netting, said alignment tube extending along a length of said netting to maintain a substantially planar orientation of said netting with respect to said upper edge;

a plurality of weights being couplable to said alignment tube to be suspended from said lower edge of said netting, each of said weights including a base portion and a mounting portion extending upwardly from said base portion, said mounting portion having a bore extending therethrough, said mounting portion of each of said weights being insertable into said alignment tube through one of a plurality of apertures in said alignment tube; and a support bar being insertable into said alignment tube and said bore of said mounting portion of each of said weights to secure said weights to said alignment tube, said base portion of each of said weights being positioned between said alignment tube and the bottom of the pool when said support bar extends through said alignment tube and said bores of said weights.

* * * * *